United States Patent [19]

Rachel

[11] 3,931,808

[45] Jan. 13, 1976

[54] ALTITUDE COMPENSATION SYSTEM FOR A FUEL MANAGEMENT SYSTEM

[75] Inventor: Todd Leonard Rachel, Yorktown, Va.

[73] Assignee: The Bendix Corporation, Southfield, Mich.

[22] Filed: Dec. 23, 1974

[21] Appl. No.: 535,399

[52] U.S. Cl...... 123/32 EA; 123/179 G; 123/179 L; 123/140 MC; 123/119 F

[51] Int. Cl.[2]..... F02D 1/04; F02B 3/00

[58] Field of Search..... 123/179 L, 179 G, 32 EA, 123/140 MC, 119 F

[56] References Cited

UNITED STATES PATENTS

| | | | |
|---|---|---|---|
| 2,948,273 | 8/1960 | Suttle | 123/32 EA |
| 3,792,693 | 2/1974 | Luchaco | 123/32 EA |
| 3,817,225 | 6/1974 | Priegel | 123/32 EA |

*Primary Examiner*—Wendell E. Burns
*Assistant Examiner*—Ronald B. Cox
*Attorney, Agent, or Firm*—Russel C. Wells

[57] ABSTRACT

In a fuel injection system for an internal combustion engine the opening time of the injectors is proportional to the amount of fuel supplied. In the system having an exhaust gas sensor closing the control loop, the sensor compensates for both barometric and altitude changes; however, until the sensor is sufficiently warmed up or for a predetermined period of time the herein disclosed altitude compensation system provides control information for injector timing to account for changes due to barometric and altitude changes.

10 Claims, 4 Drawing Figures

FIG. 1
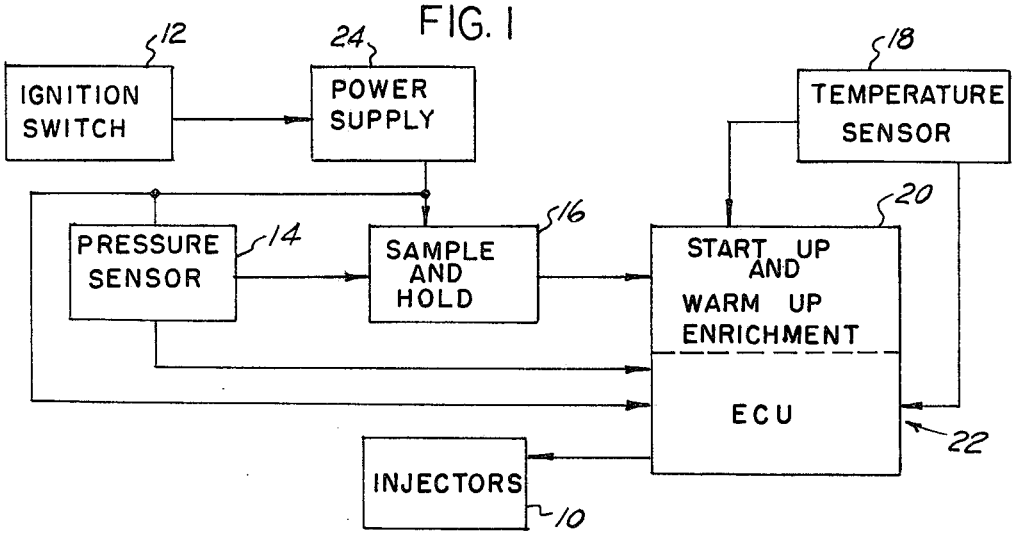
FIG. 2
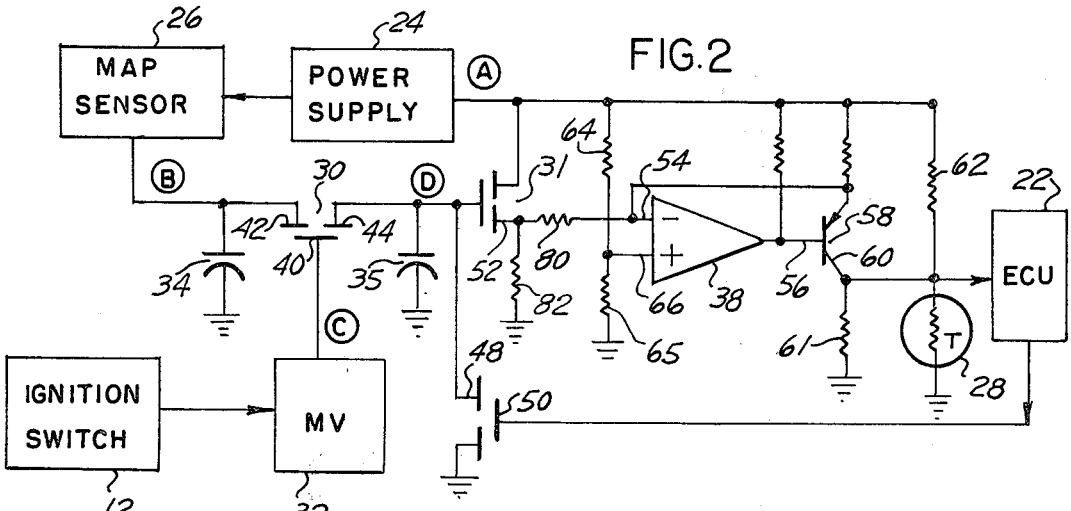
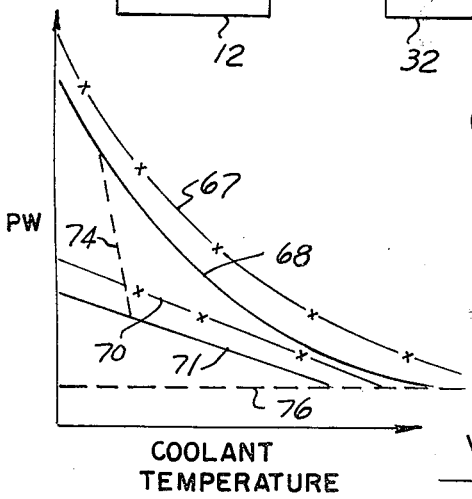
FIG. 3
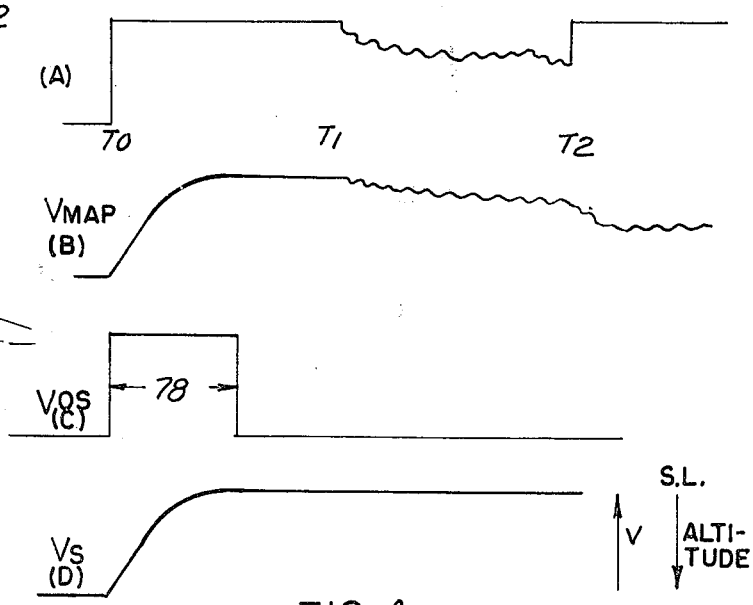
FIG. 4

ALTITUDE COMPENSATION SYSTEM FOR A FUEL MANAGEMENT SYSTEM

BRIEF SUMMARY OF THE INVENTION

In most fuel injection systems for spark ignition internal combustion engines, the most favored method of control is closed loop control. Many different methods of closed loop control may be used each utilizing a different type of component sensing, measuring or responding to a different characteristic of the engine. Speed, temperature, air flow and fuel flow are but a few of the characteristics used. One particular component used to close the control loop is an exhaust gas sensor such as an oxygen gas sensor.

The oxygen gas sensor is positioned in the exhaust system of the engine and generates a voltage signal having a first voltage level indicating the absence of oxygen in the exhaust gas indicating a rich fuel mixture and a second voltage level signal indicating the presence of oxygen in the exhaust gas indicating a lean fuel mixture. This switching point of the oxygen gas sensor is at the stoichiometric point in the composition of the exhaust gas. In the preferred embodiment the oxygen gas sensor is fabricated from zirconium oxide which responds to oxygen gas when the sensor is at elevated temperatures. In the exhaust gas sensor of the motor vehicle the exhaust gas provides the source of heat to heat the sensor to its operating temperature. When a vehicle is initially started the sensor is well below its operating temperature and a period of time must pass before the sensor has been raised to its operating temperature. When the sensor is at its operating temperature it automatically compensates by its own operation for barometric or altitude changes. However, during the warm-up periods of the engine when the vehicle is programmed to operate with a lean mixture, barometric and altitude changes can drastically effect both emissions and driveability.

This invention relates to a system permitting the warm-up profile in an exhaust gas sensor closed loop control vehicle to be compensated for barometric and altitude changes. In the preferred embodiment the system is applied to a fuel injection system for an internal combustion engine. However, this system is also applicable to a standard carburetor fuel controlled vehicle.

The altitude compensation system comprises an ignition switch which is used to initiate the starting of the internal combustion engine and also substantially simultaneously applies electrical power to the fuel injection system. An air pressure sensor which typically has as its main function to sense absolute manifold pressure is responsive to the ambient air pressure and the ignition switch means to generate an electrical signal having a voltage magnitude which is proportional to the ambient air pressure. A sample and hold circuit is responsive to said signal and the ignition switch for storing the magnitude of electrical signal from the air pressure sensing means when the ignition switch is activated and before the engine begins cranking, thus sensing true ambient pressure. An amplifier is electrically connected in circuit with the sample and hold circuit for receiving electrical signals therefrom and for generating a current signal proportional to the magnitude of the air pressure signal. The output of the amplifier means is electrically coupled to a fuel enrichment means for controlling the amount of fuel supplied to the engine by controlling or providing information to control the operating time of the injector. A temperature sensor responsive to the coolant temperature of the engine, is operative to provide a time reference sufficient to allow the exhaust gas sensor to become operative and to supply the compensation for barometric and altitude changes and to deactivate the effect of the altitude compensation system.

DESCRIPTION OF DRAWINGS

In the drawings

FIG. 1 is a block diagram schematic of the amplitude compensation system;

FIG. 2 is a circuit schematic of the system of FIG. 1;

FIG. 3 is a profile graph illustrating the relationship between the pulse width of the injector and the coolant temperature at two different altitudes for engine starting and warm-up enrichment;

FIG. 4 is a timing diagram of the waveshapes of the circuit of FIG. 2.

DETAILED DESCRIPTION

Referring to the Figs. by the characters of reference there is illustrated in FIG. 1 a block diagram of the altitude compensation system of the present invention. In the preferred embodiment the altitude compensation system is applied to a fuel injection system for controlling or providing additional control information to control the pulse width of the signal supplied to the injectors 10 of the system. The injectors 10 as illustrated in FIG. 1 are merely one form of utilization devices for the altitude compensation inasmuch as the system may be applied to any fuel management system. A utilization device is a device which relates to or controls the fuel applied to the engine. Another such device could be a carburetor.

The system as illustrated in FIG. 1 comprises an ignition switch 12, an ambient pressure sensor 14, a sample and hold circuit 16, a temperature sensor 18, a warm-up enrichment circuit 20, an electronic computing unit 22, and the utilization device 10.

The ignition switch 12 serves as its main function to supply power from the power supply 24 to initiate the starting of the internal combustion engine. In addition the ignition switch 12 operates to supply electric power to the several electrical systems operatively coupled to the engine. In the preferred embodiment when the ignition switch 12 is activated to its start or running positions, electrical power is supplied to the altitude compensation system.

The ambient pressure sensor 14 in the preferred embodiment is the absolute manifold pressure sensor 26 typically found in the manifold portion of a fuel injection controlled engine. In this application, the manifold absolute pressure or MAP sensor 26 is time shared between the altitude compensation system and the fuel injection circuit. In the alternative, an additional ambient pressure sensor may be used for the altitude compensation circuit. However, when a vehicle ignition switch 12 is initially turned on, the MAP sensor 26 senses ambient pressure inasmuch as no vacuum is drawn in the manifold until the starter motor is engaged and the engine begins to crank. The MAP sensor 26 is a transducer responding to the pressure and generating a voltage signal representing the pressure sensed.

The temperature sensor 18 illustrated in FIG. 1 is, in the preferred embodiment, the engine coolant temperature sensor, and it is basically a thermistor 28 having a positive temperature coefficient wherein the resistance of the thermistor 28 increases as the temperature of the coolant increases. In the preferred embodiment this component is normally one of the components found in the fuel management system. However, as in the case of the pressure sensor 14, a particular and special sensor may be used for accurately sensing the operating temperature of the motor vehicle or an exhaust gas sensor may also be used inasmuch as they are primarily responsive to temperature for operation.

The warm-up enrichment circuit 20 is a circuit in the ECU 22 which is necessary in all fuel management systems to provide fuel enrichment control during a cold start of the engine or when the engine is not up to proper temperature. It is primarily a function of the warm-up enrichment circuit 20 to increase the fuel flow rate to the engine during the warm up periods of the engine.

The sample and hold circuitry 16 responds to the signals from ignition switch 12 and the ambient pressure sensor 14 to initially sample the output of the ambient pressure sensor 14 when the ignition switch 12 is actuated and to hold or store that voltage level for later use. The output of the sample and hold circuit 16 is supplied to the warm-up enrichment circuit 20 to provide additional electrical control information for supplying fuel to the engine.

An electronic computing unit or ECU 22 receives all of the several sensed signals from the engine and in the preferred embodiment programs the operation of the fuel injectors 10 in response to the sensed signals. In particular, the altitude compensation system provides additional information to control the pulse width of the signal to the injectors 10 thereby controlling the amount of fuel to the engine.

The injectors 10 represent the utilization device for the altitude compensation system as has been previously stated.

Referring to FIG. 2 there is illustrated both in schematic form and block diagrammatic form, the system of FIG. 1. The sample and hold circuit 16 comprises a pair of field effect transistors 30 and 31 or FETs, a multivibrator 32 and a pair of capacitors 34 and 35. The output of the sample and hold circuit 16 is supplied through an operational amplifier 38 to the warm-up enrichment circuit 20 and of the ECU 22 for controlling the injectors 10.

The ignition switch 12 controls the multivibrator 32 whose output is electrically connected to the gate lead 40 of the first transistor 30 of the sample and hold circuit 16. The multivibrator 32 in the preferred embodiment is a monostable multivibrator in that it generates upon its activation by a signal from the ignition switch 12, a single pulse having predetermined time width. This pulse identified as $V_{os}$ in FIG. 4 is electrically coupled to the gate 40 of the first transistor 30. A voltage signal on this gate 40 drives the transistor 30 into conduction and when the signal is removed the transistor 30 is driven out of conduction.

The first transistor 30 with its gate lead 40 electrically coupled to the multivibrator 32 has its input lead 42 electrically connected to the first capacitor 34 and also to the output of pressure sensor 26. The output lead 44 of the first transistor 30 is electrically connected to one plate of the second capacitor 35, the gate lead 46 of the second transistor 31, and the input lead 48 of a discharge transistor 50. In particular, the FET transistor has a characteristic of extremely low leakage from one of its electrodes to another one of its electrodes.

The output lead 52 of the second transistor 31 is electrically connected to the inverting input 54 of the operational amplifier 38 from which a current signal is generated having a magnitude inversely proportional to the magnitude of the pressure signal. The output of the operational amplifier 38 is electrically connected to the base lead 56 of a third transistor 58 having its collector lead 60 connected to the temperature sensor 28, a voltage divider circuit comprising two resistors 61 and 62, and to the ECU 22.

The discharge transistor 15 is normally nonconducting and is responsive to a signal from the ECU 22 to discharge the second capacitor 35. This signal from the ECU 22 may be generated after the warm-up period or some other time to condition the second capacitor 35 for receiving a signal from the first capacitor 34 at the next ignition switch 12 activation as controlled by the multivibrator 32.

When the ignition switch 12 is turned on, the pressure sensor 26 senses the ambient pressure in the manifold and its voltage signal, $V_{map}$, is supplied to the first capacitor 34. When the multivibrator 32 is turned on the first transistor 30 transfers the voltage from the first capacitor 34 to the second capacitor 35 for storing. The voltage magnitude on the second capacitor 35 will maintain second transistor 31 in conduction state representing the pressure sensed by the pressure sensor 26. The first capacitor 34 is electrically connected to the pressure sensor 26 and its charge will follow the voltage level generated by the sensor 26. Thus, at all times the charge on the first capacitor 34 is representative of the pressure sensed by the pressure sensor 26.

A voltage divider circuit comprising two resistors 64 and 65 supplies a voltage level to the noninverting input 66 of the output operational amplifier to represent the ambient pressure at sea level conditions. This is the threshold control signal for the altitude compensation system.

The temperature sensor 28 is electrically coupled to the collector 60 of the third transistor 58. As previously indicated, this is a thermistor 28 and as the temperature of the engine coolant increases, its resistance increases thereby changing the signal applied to the injector control circuit. Electrically the thermistor 28 provides a variable impedance sink to the output signal of the third transistor 58.

Referring to FIG. 3 there is illustrated a graph of the profile of the pulse width in milliseconds of the signal applied to the injectors relevant to the coolant temperature of the engine at two altitude conditions corresponding to sea level and 10,000 feet. The upper pair of curves 67 and 68 represent the engine starting enrichment conditions at both altitude conditions. The lower pair of curves 70 and 71 represent the warm-up enrichment conditions at both altitude conditions. When the vehicle is being started, it is on one of the upper curves 67 or 68 until when it becomes started and the ECU 22 switches the logic from the start enrichment curve to the corresponding altitude warm-up enrichment curve. In this case, the operation of the ECU 22 effectively moves along the dash line 74 from the first curve 68 to the second curve 71. This dash line 24 in FIG. 3 represents enrichment time decay after starting. The straight line 76 parallel through the base line or X axis represents a normal hot engine pulse width for a given engine condition.

Referring to FIG. 4 there is illustrated sample waveshapes taken at several locations in the circuit of FIG. 2. Waveshape A represents the normal battery voltage in the motor vehicle and the effects on the battery voltage during the cranking conditions of starting occurring at T1 and ending at time T2. It is assumed that at T2 the engine is running and the battery is recharging at a nominal level.

Waveshape B represents the voltage output of the MAP sensor 26 and prior to the time T1, the sensor will have reached a voltage level representing the ambient pressure. At T1 when the engine is cranking, a vacuum is beginning to be formed in the manifold and the output voltage of the sensor begins to decrease as the pressure decreases.

Waveshape C of FIG. 4 represents a pulse time of the multivibrator 32. The multivibrator 32 is timed so that its pulse output width 78 will be less than time T1. It is important that the pulse width 78 be long enough to mask the rise time of the voltage pulse from the pressure sensor 26 but not long enough to extend into the cranking time.

Waveshape D of FIG. 4 illustrates the voltage level on the second capacitor 35 as the result of the conduction of the first transistor 30. The voltage magnitude of the Waveshape D will increase as the altitude approaches sea level.

Referring to FIGS. 2, 3, and 4, the operation of the altitude compensation system will be explained. Assume for the purposes of discussion that the internal combustion engine is cold and at sea level. Referring to FIG. 3 with the coolant temperature being cold and thereby substantially at the left of the graph, the ECU will be operating along the upper solid curve 68 until some point when the ECU transfers to the lower solid curve 71 along the dash line 74. Eventually after the engine is warmed up and the coolant temperature increases, the ECU 22 is generating a pulse width consistent with the lower solid curve 71 which eventually intercepts the standard hot engine operating curve 76.

When the engine is about to be started, the ignition switch 12 is closed supplying electrical power to all the electrical circuits including the MAP sensor 26. In addition when the ignition switch 12 is initially closed, a signal is generated to the input of the multivibrator 32 generating the output pulse $V_{os}$ as illustrated in FIG. 4 Waveshape C. Additionally, when the power is applied as indicated in Waveshape B of FIG. 4, the pressure sensor 26 begins to generate a voltage output signal $V_{map}$ which is substantially that illustrated in FIG. 4B. These operations all begin at time T0 as shown in FIG. 4A. In the preferred embodiment the time length of the multivibrator is 20 milliseconds which is much less than the time period from T0 to T1. Any noise or high frequency voltage signals generated by the pressure sensor are filtered by the first capacitor 34 and the main voltage signal of FIG. 4B is transferred by the first transistor 30 from its input to its output circuit to charge the second capacitor 35 as illustrated in FIG. 4D.

At the end of the multivibrator timing, the first transistor 30 is driven out of conduction and both capacitors 34 and 35 are charged up to the voltage $V_{map}$. The second transistor 31 is then driven into conduction due to the voltage charge on the second capacitor 35 and current flows from the input lead to the output lead 52 of the second transistor 31. The output lead 52 of the second transistor is connected through a resistor 80 to the inverting input 54 of the operational amplifier 38 and is also connected through a resistor 82 to the return of the power supply 24. The resistor 80 between the output lead 52 of the second transistor 31 and the inverting input 54 of the operational amplifier 38 functions to limit the current input to the amplifier 38. As previously indicated, the noninverting input 66 of the operational amplifier 38 is biased at a voltage level representing a reference altitude such as sea level. Since for the purposes of explanation, the circuit is at sea level, the output of the operational amplifier 38 which is connected to the base lead 56 of the third transistor 58 is at a nominal or normal voltage such as that at the noninverting input 66 of the operational amplifier. This causes the third transistor 58 to be driven into conduction supplying additional current to the ECU 22 controlling the utilization device. The output of the third transistor 58 is also connected to the coolant temperature thermistor 28 so that as the coolant warms up the resistance of the thermistor increases and in effect acting as a current sink to the third transistor 58 in reducing the current input to the ECU 22.

After the engine is started as previously indicated, the ECU 22 effectively travels along the interconnecting line 74 from the starting enrichment curve 68 to the warm-up enrichment curve 71 of FIG. 3. This will then correct the pulse width to correspond to the desired width for warm-up enrichment.

When at an elevated temperature and the engine is to be started, the MAP sensor 26 or pressure sensor 14 is responsive to the ambient pressure of the vehicle. When the ignition switch 12 is turned on and the voltage is supplied to the pressure sensor 14 a voltage level is built up reflecting the ambient pressure.

This voltage level as previously indicated is less than the voltage level pressure sensor 14 would generate at sea level. At an elevated amplitude it is necessary that the amount of fuel supplied to the engine be greater, therefore, as illustrated in FIG. 3, the ECU 22 is following the locus of the upper curves 67 and 70 of each pair of curves. In a manner similar to sea level operation, the ECU 22 begins on the uppermost curve 67 until the engine becomes turned on and then transfers to the lower curve 70.

There has thus been shown and described an altitude compensation system for a fuel injection system to provide the necessary information to the injectors until the exhaust gas sensor is brought up to its operation conditions.

I claim:

1. In a fuel management system for an internal combustion engine an altitude compensation system for adjusting the amount of fuel supplied to the engine for a period of time dependent upon engine temperature, said altitude compensation system comprises:

ignition switch means for initiating the starting of the engine;

a temperature sensing means for sensing the operating temperature of the engine and generating an electrical signal in response thereto;

air pressure sensing means responsive to the ambient air pressure of the engine and responsive to said ignition switch means for generating an electrical signal representing the ambient air pressure when said switch means is actuated;

fuel enrichment means responsive to said electrical signal from said temperature sensing means for increasing the amount of fuel supplied to the engine until said engine temperature reaches a predetermined value; and control circuit means responsive to said ignition switch means for receiving and storing said electrical pressure signal from said air pressure sensing means and operative to apply said electrical pressure signal to said fuel enrichment means for modifying the amount of fuel supplied to said engine in accordance with ambient air pressure until said engine temperature reaches a predetermined value.

2. In the altitude compensation system according to claim 1 wherein said air pressure sensing means is a manifold pressure sensor means responsive to the air pressure in the manifold of the internal combustion engine and generates an electrical signal in response thereto.

3. In the altitude compensation system according to claim 1 wherein said control circuit means comprises:

a first transistor having an input, an output, and a gate electrode wherein said input electrode is electrically coupled to receive said electrical signal from said air pressure sensing means;

a second transistor having an input, an output, and a gate electrode, said output electrode electrically connected in circuit to said fuel enrichment means and said gate electrode is electrically connected to the output electrode of said first transistor;

a voltage storage means electrically connected to the output of said first transistor and adapted to store said electrical signal thereon, and a monostable multivibrator responsive to said ignition switch means for generating an output signal of a predetermined time length, said output signal being coupled to the gate electrode of said first transistor for controlling the conduction thereof and transferring the electrical signal from the input thereof to said voltage storage means.

4. In the altitude compensation system according to claim 3 wherein said first and second transistors are field effect transistors.

5. In the altitude compensation system according to claim 3 wherein the pulse width of the output signal of said multivibrator does not overlap the initiation of the cranking of the internal combustion engine.

6. In a fuel injection system for an internal combustion engine an altitude compensation system controlling the warm-up enrichment circuit in the injector control unit, said altitude compensation system comprising:

ignition switch means for initiating the starting of an internal combustion engine and substantially simultaneously applying electrical power to the fuel injection system;

air pressure sensing means responsive to the ambient air pressure and said ignition switch means and operative to generate an electrical signal having a voltage magnitude proportional to the ambient air pressure;

sample and hold circuit means responsive to said ignition switch means and the electrical signal generated by said air pressure sensing means and operative to sample and store the magnitude of said electrical signal;

timing generating means responsive to the initiation of the activation of said ignition switch means and electrically coupled to said sample and hold circuit for controlling the sampling time of said electrical signal;

operational amplifier means electrically connected in circuit with and responsive to said sample and hold circuit means for generating a current signal inversely proportional to the magnitude of said signal;

temperature sensing means responsive to the coolant temperature of the internal combustion engine and operative to vary its impedance in response thereto for modifying the magnitude of the said current signal in response to the change in coolant temperature; and fuel enrichment circuit responsive to said modified current signal for controlling the amount of fuel supplied to the engine in an inverse relationship to the magnitude of the coolant temperature.

7. In the altitude compensation system according to claim 6 wherein said air pressure sensing means is a manifold pressure sensor means responsive to the air pressure in the manifold of the internal combustion engine and generates an electrical signal in response thereto.

8. In the altitude compensation system according to claim 6 wherein said sample and hold circuit comprises:

a first transistor having an input, an output, and a gate electrode wherein said input electrode is electrically coupled to receive said electrical signal from said air pressure sensing means;

a second transistor having an input, an output, and a gate electrode, said output electrode electrically connected in circuit to said fuel enrichment means and said gate electrode is electrically connected to the output electrode of said first transistor; and a voltage storage means electrically connected to the output electrode of said first transistor and adapted to store said electrical signal thereon.

9. In the altitude compensation system according to claim 8 wherein said timing generating means comprises a monostable multivibrator responsive to said ignition switch means for generating an output signal of a predetermined time length, said output signal being coupled to the gate electrode of said first transistor for controlling the conduction thereof and transferring the electrical signal from the input electrode thereof to said voltage storage means.

10. In the altitude compensation system according to claim 8 wherein said first and second transistors are field effect transistors.

* * * * *